US010297203B2

(12) United States Patent
Li

(10) Patent No.: US 10,297,203 B2
(45) Date of Patent: May 21, 2019

(54) SCANNING DRIVING CIRCUIT AND FLAT DISPLAY APPARATUS HAVING THE SCANNING DRIVING CIRCUIT

(71) Applicant: Wuhan China Star Optoelectronics Technology Co., Ltd., Wuhan, Hubei (CN)

(72) Inventor: Yafeng Li, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 170 days.

(21) Appl. No.: 15/308,557

(22) PCT Filed: Sep. 28, 2016

(86) PCT No.: PCT/CN2016/099221

§ 371 (c)(1),
(2) Date: Nov. 2, 2016

(87) PCT Pub. No.: WO2018/023859

PCT Pub. Date: Feb. 8, 2018

(65) Prior Publication Data

US 2018/0190201 A1 Jul. 5, 2018

(30) Foreign Application Priority Data

Aug. 5, 2016 (CN) ..... 2016 1 0639673

(51) Int. Cl.
*G09G 3/3266* (2016.01)
*G09G 3/36* (2006.01)

(52) U.S. Cl.
CPC ..... *G09G 3/3266* (2013.01); *G09G 3/3674* (2013.01); *G09G 3/3677* (2013.01); *G09G 2310/0283* (2013.01); *G09G 2310/0286* (2013.01); *G09G 2320/0214* (2013.01)

(58) Field of Classification Search
CPC ..... G09G 2310/0283; G09G 2310/08; G09G 3/2092; G09G 3/3266; G09G 3/3674; G09G 2310/0267; G09G 2310/0264
See application file for complete search history.

(56) References Cited

U.S. PATENT DOCUMENTS 8,830,156 B2 9/2014 Kim et al.
2004/0125069 A1* 7/2004 Park ..... G09G 3/3666 345/100
2015/0043703 A1 2/2015 Tan et al.
(Continued)

FOREIGN PATENT DOCUMENTS

KR 1020140064319 A 5/2014

*Primary Examiner* — Nelson M Rosario
*Assistant Examiner* — Scott Au
(74) *Attorney, Agent, or Firm* — Andrew C. Cheng

(57) ABSTRACT

The present application discloses a scanning driving circuit and a flat display apparatus, the scanning driving circuit includes a plurality of cascaded scanning driving unit, each scanning driving unit including a forward and reverse scanning circuit for controlling the forward or reverse scanning; an input circuit to perform charging to the pull-up control signal point and the pull-down control signal point; a leakage prevention circuit to preform a process to the leakage of the input circuit; an output circuit to generate a scanning driving signal and output to the level scanning line to drive a pixel unit.

9 Claims, 4 Drawing Sheets

(56) References Cited

U.S. PATENT DOCUMENTS

| | | | | |
|---|---|---|---|---|
| 2015/0302934 | A1 | 10/2015 | Qi et al. | |
| 2016/0071614 | A1* | 3/2016 | Lee | G09G 5/006 345/214 |
| 2016/0189584 | A1 | 6/2016 | Xiao | |
| 2016/0189648 | A1 | 6/2016 | Xiao | |
| 2017/0285374 | A1 | 10/2017 | Li et al. | |

* cited by examiner

SCANNING DRIVING CIRCUIT AND FLAT DISPLAY APPARATUS HAVING THE SCANNING DRIVING CIRCUIT

FIELD OF THE INVENTION

The present application relates to a display technology field, and more particularly to a scanning driving circuit and a flat display apparatus having the scanning driving circuit.

BACKGROUND OF THE INVENTION

A scanning driving circuit is used in the flat panel display device currently, that is forming the scanning driving circuit on the array substrate by using the conventional thin-film transistor array process of the flat panel display, to achieve the driving mode of scanning row by row. In design of the conventional scanning driving circuit, in order to ensure the stability of the output signal of the scanning line, a pull-up control signal point Q is set (as illustrated in FIGS. 1 to 3, wherein FIG. 1 illustrates a circuit diagram of one scanning driving unit of the conventional scanning driving circuit, FIGS. 2 and 3 illustrate a forward scanning waveform diagram and a reverse scanning waveform of FIG. 1), in order to prevent the clock signal CKV2 from low electrical level to high electrical level, a capacitor C1 bootstrap the pull-up control signal point Q to a higher electrical level and causes a serious impact on a thin-film transistor T6, a thin film transistor T5 is provided, when a H point is pre-charged, the thin film transistor T5 is in an on state, the pull-up control signal point Q is also pre-charged in the same time, when the clock signal CKV2 goes from low electrical level into high electrical level, the function of the bootstrap of the capacitor C1 will pull up the pull-up control signal point Q, the voltage Vgs between the gate electrode and the source electrode of the thin film transistor T5 is equal to 0V, when the switching characteristics of the thin film transistor is good, the point H goes on to maintain the high electrical potential corresponding to the pre-charge, the pull-up control signal point Q will also continue to maintain a high electrical level after the bootstrap of the capacitor C1, the thin film transistor T6 will not be serious impacted because of the capacitor C1 bootstrap the pull-up control signal point Q to a higher electrical potential, however, because of the process causing the characteristics of the switch of the thin film transistor is degraded, the thin film transistor T5 is in a serious leakage state, after the bootstrap of the capacitor C1, the pull-up control signal point Q is pulled to low electrical potential by the H point, resulting in unstable output signal of the scanning line Gn, thereby affecting the display effect of the panel.

SUMMARY OF THE INVENTION

The present application to solve the technical problem is to provide a scanning driving circuit and a flat display apparatus having the scanning driving circuit to effectively solve the problems of unstable output signal of the scanning line caused by the leakage of the thin film transistor, in order to improve the display performance of the panel.

In order to solve the above problems, a technical approach adapted in the present application is to provide a scanning driving circuit, wherein the scanning driving circuit comprising a plurality of cascaded scanning driving unit, each scanning driving unit including:

a forward and reverse scanning circuit for receiving a previous level scanning signal and a first clock signal and outputting a first control signal to control the scanning driving circuit performing forward scanning, or for receiving a next level scanning signal and a second clock signal and outputting a second control signal to control the scanning driving circuit performing reverse scanning;

an input circuit connected to the forward and reverse scanning circuit, for receiving a third clock signal and receiving the first and the second control signal from the forward and reverse scanning circuit, and according to the third clock signal, the first and the second control signal to perform charging to the pull-up control signal point and the pull-down control signal point;

a leakage prevention circuit connected to the input circuit, for receiving the first clock signal and the second clock signal, and preform a process to the leakage of the input circuit according to the first and the second clock signal; and an output circuit connected to the input circuit for preforming a process to a received fourth control signal and a data received from the input circuit, generating a scanning driving signal and outputting to the level scanning line to drive a pixel unit.

Wherein the forward and reverse scanning circuit including a first controllable switch and a second controllable switch, the control terminal of the first controllable switch receives the first clock signal, a first terminal of the controllable switch receives the previous level scanning signal, a second terminal of the first controllable switch is connected to the first terminal of the second controllable switch and the input circuit, a control terminal of the second controllable switch receives the second clock signal, a second terminal of the second controllable switch receives the next level scanning signal.

Wherein the input circuit including a third to seventh controllable switches, a first and second capacitors, a control terminal of the third controllable switch is connected to the leakage prevention circuit, a first terminal of the third controllable switch is connected to a control terminal of the fourth controllable switch, the second terminal of the first controllable switch and the first terminal of the second controllable switch, a second terminal of the third controllable switch is connected to a first terminal of the fifth controllable switch and the output circuit, a second terminal of the fifth controllable switch is connected to a second terminal of the fourth controllable switch, a second terminal of the sixth controllable switch and a second terminal of the seventh controllable switch receive a turn-off voltage terminal signal, a control terminal of the fifth controllable switch is connected to a first terminal of the fourth controllable switch and a control terminal of the sixth controllable switch, a first terminal of the sixth controllable switch is connected to a first terminal of the seventh controllable switch and the output circuit, a control terminal of the seventh controllable switch receives the third clock signal, a first terminal of the first capacitor is connected to the control terminal of the fifth controllable switch, a second terminal of the first capacitor is connected to the output circuit, the second capacitor is connected between the control terminal and the second terminal of the sixth controllable switch.

Wherein the leakage prevention circuit including an eighth to tenth controllable switches, a control terminal of the eighth controllable switch receives the first clock signal, a first terminal of the eighth controllable switch is connected to a first terminal of the ninth controllable switch and receives a turn-on voltage terminal signal, a second terminal of the eighth controllable switch is connected to a second terminal of the ninth controllable switch, a second terminal of the tenth controllable switch and the control terminal of the third controllable switch, a control terminal of the ninth controllable switch receives the second clock signal, a first terminal of the tenth controllable switch receives the turn-off voltage terminal signal, a control terminal of the tenth controllable switch is connected to the second terminal of the first capacitor and the output circuit.

Wherein the output circuit including an eleventh controllable switch and a third capacitor, a control terminal of the eleventh controllable switch is connected to the second terminal of the third controllable switch and the first terminal of the fifth controllable switch, a first terminal of the eleventh controllable switch is connected to the control terminal of the tenth controllable switch and the second terminal of the first capacitor and receives the fourth clock signal, a second terminal of the eleventh controllable switch is connected to the first terminals of the sixth and seventh controllable switches and the level scanning line, the third capacitor is connected between the control terminal and the second terminal of the eleventh controllable switch.

Wherein the first to eleventh controllable switches are N-type thin film transistors, the control terminals, the first terminals and the second terminals of the first to eleventh controllable switches are corresponding to gate, drain and source electrodes of the N-type thin film transistors, respectively.

In order to solve the above problems, the other technical approach adapted in the present application is to provide a flat display apparatus, wherein the flat display apparatus including a scanning driving circuit, the scanning driving circuit including a plurality of cascaded scanning driving unit, each scanning driving unit including:

a forward and reverse scanning circuit for receiving a previous level scanning signal and a first clock signal and outputting a first control signal to control the scanning driving circuit performing forward scanning, or for receiving a next level scanning signal and a second clock signal and outputting a second control signal to control the scanning driving circuit performing reverse scanning;

an input circuit connected to the forward and reverse scanning circuit, for receiving a third clock signal and receiving the first and the second control signal from the forward and reverse scanning circuit, and according to the third clock signal, the first and the second control signal to perform charging to the pull-up control signal point and the pull-down control signal point;

a leakage prevention circuit connected to the input circuit, for receiving the first clock signal and the second clock signal, and preform a process to the leakage of the input circuit according to the first and the second clock signal; and an output circuit connected to the input circuit for preforming a process to a received fourth control signal and a data received from the input circuit, generating a scanning driving signal and outputting to the level scanning line to drive a pixel unit.

Wherein the forward and reverse scanning circuit including a first controllable switch and a second controllable switch, the control terminal of the first controllable switch receives the first clock signal, a first terminal of the controllable switch receives the previous level scanning signal, a second terminal of the first controllable switch is connected to the first terminal of the second controllable switch and the input circuit, a control terminal of the second controllable switch receives the second clock signal, a second terminal of the second controllable switch receives the next level scanning signal.

Wherein the input circuit including a third to seventh controllable switches, a first and second capacitors, a control terminal of the third controllable switch is connected to the leakage prevention circuit, a first terminal of the third controllable switch is connected to a control terminal of the fourth controllable switch, the second terminal of the first controllable switch and the first terminal of the second controllable switch, a second terminal of the third controllable switch is connected to a first terminal of the fifth controllable switch and the output circuit, a second terminal of the fifth controllable switch is connected to a second terminal of the fourth controllable switch, a second terminal of the sixth controllable switch and a second terminal of the seventh controllable switch receive a turn-off voltage terminal signal, a control terminal of the fifth controllable switch is connected to a first terminal of the fourth controllable switch and a control terminal of the sixth controllable switch, a first terminal of the sixth controllable switch is connected to a first terminal of the seventh controllable switch and the output circuit, a control terminal of the seventh controllable switch receives the third clock signal, a first terminal of the first capacitor is connected to the control terminal of the fifth controllable switch, a second terminal of the first capacitor is connected to the output circuit, the second capacitor is connected between the control terminal and the second terminal of the sixth controllable switch.

Wherein the leakage prevention circuit including an eighth to tenth controllable switches, a control terminal of the eighth controllable switch receives the first clock signal, a first terminal of the eighth controllable switch is connected to a first terminal of the ninth controllable switch and receives a turn-on voltage terminal signal, a second terminal of the eighth controllable switch is connected to a second terminal of the ninth controllable switch, a second terminal of the tenth controllable switch and the control terminal of the third controllable switch, a control terminal of the ninth controllable switch receives the second clock signal, a first terminal of the tenth controllable switch receives the turn-off voltage terminal signal, a control terminal of the tenth controllable switch is connected to the second terminal of the first capacitor and the output circuit.

Wherein the output circuit including an eleventh controllable switch and a third capacitor, a control terminal of the eleventh controllable switch is connected to the second terminal of the third controllable switch and the first terminal of the fifth controllable switch, a first terminal of the eleventh controllable switch is connected to the control terminal of the tenth controllable switch and the second terminal of the first capacitor and receives the fourth clock signal, a second terminal of the eleventh controllable switch is connected to the first terminals of the sixth and seventh controllable switches and the level scanning line, the third capacitor is connected between the control terminal and the second terminal of the eleventh controllable switch.

The advantage of the present application is comparing to the conventional technology, the scanning driving circuit of the present application performs the forward scanning and reverse scanning by the scanning driving circuit controlled by the forward and reverse scanning circuit, and by the input circuit to charge the pull-up control signal point and the pull-down control signal point, by the leakage prevention circuit to prevent the thin film transistor from leakage and resulting in unstable output signal of the scanning line, by the output circuit generating the scanning driving signal and outputting to the scanning line to drive the pixel unit to effectively solve the problems of unstable output signal of the scanning line caused by the leakage of the thin film transistor, in order to improve the display performance of the panel.

BRIEF DESCRIPTION OF THE DRAWINGS

In order to more clearly illustrate the embodiments of the present application or prior art, the following figures will be described in the embodiments are briefly introduced. It is obvious that the drawings are merely some embodiments of the present application, those of ordinary skill in this field can obtain other figures according to these figures without paying the premise.

DETAILED DESCRIPTION OF PREFERRED EMBODIMENTS

Embodiments of the present application are described in detail with the technical matters, structural features, achieved objects, and effects with reference to the accompanying drawings as follows. It is clear that the described embodiments are part of embodiments of the present application, but not all embodiments. Based on the embodiments of the present application, all other embodiments to those of ordinary skill in the premise of no creative efforts obtained should be considered within the scope of protection of the present application.

Specifically, the terminologies in the embodiments of the present application are merely for describing the purpose of the certain embodiment, but not to limit the invention. Examples and the claims be implemented in the present application requires the use of the singular form of the book "an", "the" and "the" are intend to include most forms unless the context clearly dictates otherwise. It should also be understood that the terminology used herein that "and/or" means and includes any or all possible combinations of one or more of the associated listed items.

Figure 1:
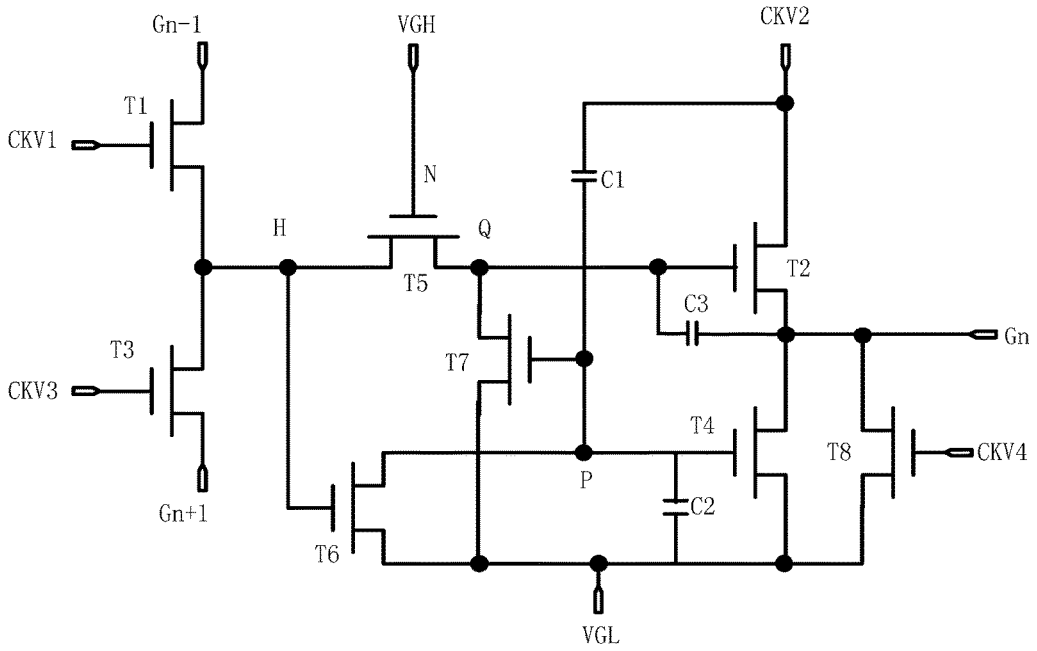
FIG. 1 illustrates a circuit diagram of one scanning driving unit of the conventional scanning driving circuit.
Figure 2:
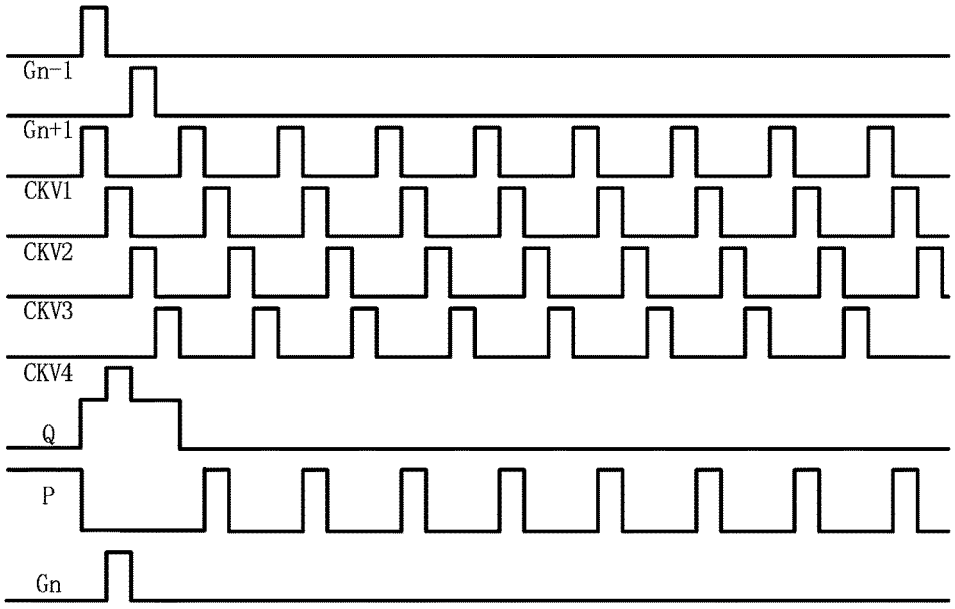
FIG. 2 illustrates a forward scanning waveform diagram of FIG. 1.

Referring to FIG. 1 and FIG. 2, the working principle (forward scanning) of the scanning driving circuit in the conventional technology is as follows:

Pre-charge phase: the scanning signal of a previous level Gn−1 and a clock signal CKV1 simultaneously in a high electrical level, a thin film transistor T1 is turned on, H point is pre-charged, the thin film transistor T5 has been in the on state, the pull-up control signal point Q is charged, when the H point is high electrical level, the thin-film transistor T6 is in the on state, the pull-down control signal point P is pull down;

The scanning line Gn output high electrical level phase: the gate electrode of the thin film transistor T5 receives a turn-on voltage terminal signal VGH and has been in the on state, in the pre-charge phase, the pull-up control signal point Q is pre-charged, a capacitor C3 has a certain holding effect to the charge, a thin film transistor T2 is in the on state, the high electrical level of the clock signal CKV2 output to the scanning line Gn;

The scanning line Gn output low electrical level phase: when a clock signal CKV3 and a next level scanning signal Gn+1 are high electrical level at the same time, the pull-up control signal point Q is maintained at a high electrical level, at the time the low electrical level of the clock signal CKV2 pull down the electrical potential of the scanning line Gn;

The pull-up control signal point Q is pulled down to the turn-off voltage terminal signal VGL phase: when the clock signal CKV1 further turns to the high electrical level, the previous level scanning signal Gn−1 is in low electrical level, the thin film transistor T1 is in the on state, then the pull-up control signal point Q is pulled down to the turn-off voltage terminal signal VGL;

The low electrical level maintaining phase of the pull-up control signal point Q and the scanning line Gn: when the pull-up control signal point Q is became in low electrical level, the thin film transistor T6 is in the off state, after the clock signal CKV2 becoming a high electrical level, due to the coupling of a capacitor C1, the pull-down control signal point P becomes in a high electrical level, then the thin film transistors T4 and T7 are in a on state to guarantee the stable low electrical level of the pull-up control signal point Q and the scanning line Gn.

Figure 3:
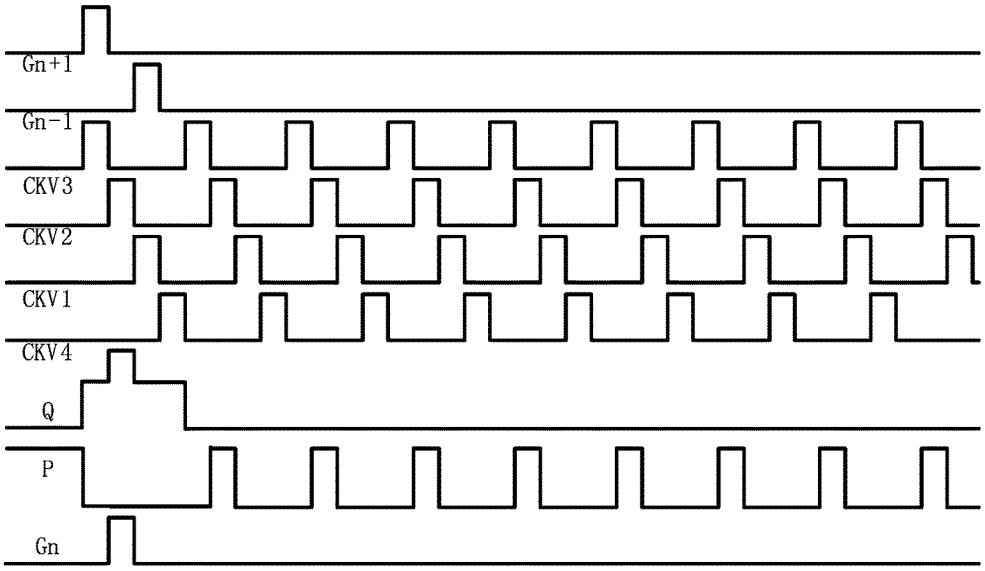
FIG. 3 illustrates a reverse scanning waveform diagram of FIG. 1.

Referring to FIG. 1 and FIG. 3, the working principle (reverse scanning) of the scanning driving circuit in the conventional technology is as follows:

Pre-charge phase: the next level scanning signal Gn+1 and the clock signal CKV3 are simultaneously in a high electrical level, the thin film transistor T3 is turned on, the H point is pre-charged, the thin film transistor T5 has been in the on state, the pull-up control signal point Q is charged, when the H point is in high electrical level, the thin-film transistor T6 is in the on state, the pull-down control signal point P is pull down;

The scanning line Gn output high electrical level phase: the gate electrode of the thin film transistor T5 receives a turn-on voltage terminal signal VGH and has been in the on state, in the pre-charge phase, the pull-up control signal point Q is pre-charged, the capacitor C3 has a certain holding effect to the charge, the thin film transistor T2 is in the on state, the high electrical level of the clock signal CKV2 output to the scanning line Gn;

The scanning line Gn output low electrical level phase: the clock signal CKV1 and the previous level scanning signal Gn−1 are high electrical level at the same time, the pull-up control signal point Q is maintained at a high electrical level, at the time the low electrical level of the clock signal CKV2 pull down the electrical potential of the scanning line Gn;

The pull-up control signal point Q is pulled down to the turn-off voltage terminal signal VGL phase: when the clock signal CKV3 further turns to the high electrical level, the next level scanning signal Gn+1 is in low electrical level, the thin film transistor T3 is in the on state, then the pull-up control signal point Q is pulled down to the turn-off voltage terminal signal VGL;

The low electrical level maintaining phase of the pull-up control signal point Q and the scanning line Gn: when the pull-up control signal point Q is became in low electrical level, the thin film transistor T6 is in the off state, after the clock signal CKV2 becoming a high electrical level, due to the coupling of a capacitor C1, the pull-down control signal point P becomes in a high electrical level, then the thin film transistors T4 and T7 are in a on state to guarantee the stable low electrical level of the pull-up control signal point Q and the scanning line Gn.

In the conventional scanning driving circuit, in order to prevent the clock signal CKV2 from low electrical level to high electrical level, the capacitor C1 bootstrap the pull-up control signal point Q to a higher electrical level and causes a serious impact on the thin-film transistor T6, the thin film transistor T5 is provided, when the H point is pre-charged, the thin film transistor T5 has been in the on state, therefore the pull-up control signal point Q is also be pre-charged in the same time, when the clock signal CKV2 goes from low electrical level into high electrical level, the function of the bootstrap of the capacitor C1 will pull up the pull-up control signal point Q, the voltage Vgs between the gate electrode and the source electrode of the thin film transistor T5 is equal to 0V, when the switching characteristics of the thin film transistor is good, the point H goes on to maintain the high electrical potential corresponding to the pre-charge, the pull-up control signal point Q will also continue to maintain a high electrical level after the bootstrap of the capacitor C1, the thin film transistor T6 will not be serious impacted because of the capacitor C1 bootstrap the pull-up control signal point Q to a higher electrical potential, however, because of the process causing the characteristics of the switch of the thin film transistor is degraded, the thin film transistor T5 is in a serious leakage state, after the bootstrap of the capacitor C1, the pull-up control signal point Q is pulled to low electrical potential by the H point, resulting in unstable output signal of the scanning line Gn, thereby affecting the display effect of the panel.

Figure 4:
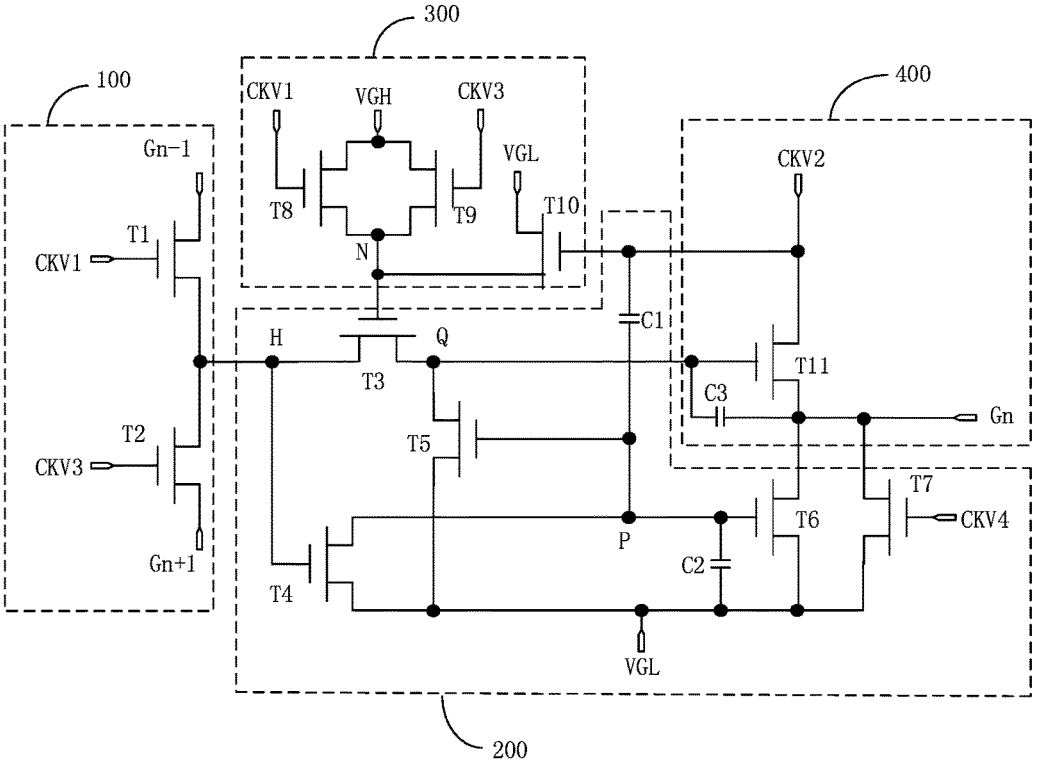
FIG. 4 illustrates a circuit diagram of one scanning driving unit of the scanning driving circuit in accordance of a first embodiment of the present application.

Referring to FIG. 4, FIG. 4 illustrates a circuit diagram of one scanning driving unit of the scanning driving circuit in accordance of a first embodiment of the present application. In the present embodiment, only a scanning driving unit is as an example to be described. As illustrated in FIG. 4, the scanning driving circuit of the present application includes a plurality of cascaded scanning driving unit, each scanning driving unit including a forward and reverse scanning circuit 100 for receiving the previous level scanning signal and the first clock signal and outputting the first control signal to control the scanning driving circuit performing forward scanning, or for receiving the next level scanning signal and the second clock signal and outputting the second control signal to control the scanning driving circuit performing reverse scanning;

An input circuit 200 is connected to the forward and reverse scanning circuit 100, for receiving the third clock signal and receiving the first and the second control signal from the forward and reverse scanning circuit, and according to the third clock signal and the first and the second control signal to perform charge to the pull-up control signal point and the pull-down control signal point;

A leakage prevention circuit 300 is connected to the input circuit 200, for receiving the first clock signal and the second clock signal, and preform a process to the leakage of the input circuit according to the first and the second clock signal; and An output circuit 400 is connected to the input circuit 200 for preforming a process to a received fourth control signal and a data received from the input circuit 200, generating the scanning driving signal and outputting to the level scanning line to drive the pixel unit.

The forward and reverse scanning circuit 100 includes a first controllable switch T1 and a second controllable switch T2, the control terminal of the first controllable switch T1 receives the first clock signal, a first terminal of the controllable switch T1 receives the previous level scanning signal, a second terminal of the first controllable switch T1 is connected to the first terminal of the second controllable switch T2 and the input circuit 200, a control terminal of the second controllable switch T2 receives the second clock signal, a second terminal of the second controllable switch T2 receives the next level scanning signal.

The input circuit 200 includes a third to seventh controllable switches T3-T7, the first and second capacitors C1, C2, a control terminal of the third controllable switch T3 is connected to the leakage prevention circuit 300, a first terminal of the third controllable switch T3 is connected to a control terminal of the fourth controllable switch T4, the second terminal of the first controllable switch T1 and the first terminal of the second controllable switch T2, a second terminal of the third controllable switch T3 are connected to a first terminal of the fifth controllable switch T5 and the output circuit 400, a second terminal of the fifth controllable switch T5 is connected to a second terminal of the fourth controllable switch T4, a second terminal of the sixth controllable switch T6 and a second terminal of the seventh controllable switch T7 receive the turn-off voltage terminal signal VGL, a control terminal of the fifth controllable switch T5 is connected to a first terminal of the fourth controllable switch T4 and a control terminal of the sixth controllable switch T6, a first terminal of the sixth controllable switch T6 is connected to a first terminal of the seventh controllable switch T7 and the output circuit 400, a control terminal of the seventh controllable switch T7 receives the third clock signal, a first terminal of the first capacitor C1 is connected to the control terminal of the fifth controllable switch T5, a second terminal of the first capacitor C1 is connected to the output circuit 400, the second capacitor C2 is connected between the control terminal and the second terminal of the sixth controllable switch T6.

The leakage prevention circuit 300 includes an eighth to tenth controllable switches T8-T10, a control terminal of the eighth controllable switch T8 receives the first clock signal, a first terminal of the eighth controllable switch T8 is connected to a first terminal of the ninth controllable switch T9 and receives a turn-on voltage terminal signal VGH, a second terminal of the eighth controllable switch T8 is connected to a second terminal of the ninth controllable switch T9, a second terminal of the tenth controllable switch T10 and the control terminal of the third controllable switch T3, a control terminal of the ninth controllable switch T9 receives the second clock signal, a first terminal of the tenth controllable switch T10 receives the turn-off voltage terminal signal VGL, a control terminal of the tenth controllable switch T10 is connected to the second terminal of the first capacitor C1 and the output circuit 400. The output circuit 400 includes an eleventh controllable switch T11 and a third capacitor C3, a control terminal of the eleventh controllable switch T11 is connected to the second terminal of the third controllable switch T3 and the first terminal of the fifth controllable switch T5, a first terminal of the eleventh controllable switch T11 is connected to the control terminal of the tenth controllable switch T10 and the second terminal of the first capacitor C1 and receives a fourth clock signal, a second terminal of the eleventh controllable switch T11 is connected to the first terminals of the sixth and seventh controllable switches T6, T7 and the level scanning line, a third capacitor C3 is connected between the control terminal and the second terminal of the eleventh controllable switch T11.

In the present embodiment, the first to eleventh controllable switches T1-T11 are N-type thin film transistors, the control terminals, the first terminals and the second terminals of the first to eleventh controllable switches T1-T11 are corresponding to gate, drain and source electrodes of the N-type thin film transistors, respectively. In other embodiments, the first to eleventh controllable switches can also be other types of switches, as long as to realize the purpose of the present application.

In the present embodiment, the previous level scanning signal is the previous level scanning signal Gn−1, the next level scanning signal is the next level scanning signal Gn+1, the first clock signal is a clock signal CKV1, the second clock signal is a clock signal CKV3, the third clock signal is the clock signal CKV4, the fourth clock signal is the clock signal CKV2, the pull-up control signal point is the pull-up control signal point Q, the pull-down control signal point is the pull-down control signal point P.

Figure 5:
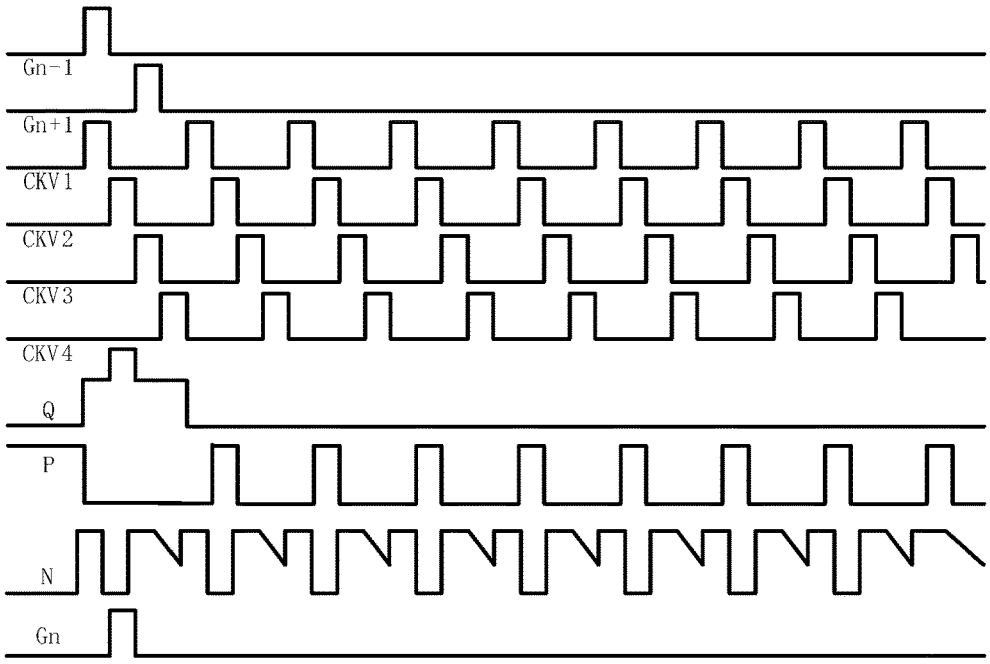
FIG. 5 illustrates a forward scanning waveform diagram of FIG. 4.

Referring to FIGS. 4 and 5, the working principle (forward scanning) of a scanning driving unit of the scanning driving circuit is as follows:

Pre-charge phase: the previous level scanning signal Gn−1 and the first clock signal CKV1 simultaneously in a high electrical level, the first controllable switch T1 is turned on, the H point is pre-charged, the first clock signal CKV1 is in a high electrical level, the eighth controllable switch T8 is in a on state, the N point is in a high electrical level, the third controllable switch T3 is turned on, the pull-up control signal point Q is charged, when the H point is high electrical level, the fourth controllable switch T4 is in the on state, the pull-down control signal point P is pull down;

The scanning line Gn output high electrical level phase: when the fourth clock signal CKV2 is from the low electrical level to the high electrical level, the pull-up control signal point Q is further pull up by the function of the bootstrap of the capacitor C1, at this time the first clock signal CKV1 and the second clock signal CKV3 are in low electrical level, the eighth controllable switch T8 and the ninth controllable switch T9 are turned off, the tenth controllable switch T10 in on state, the N point is pulled down to the turn-off voltage terminal signal VGL, the third controllable switch T3 is in a turned off state, since the third capacitor C3 has a certain holding effect to the charge, the eleven controllable switch T11 is in a on state, the high electrical level of the fourth clock signal CKV2 is output to the scanning line Gn;

The scanning line Gn output low electrical level phase: the second clock signal CKV3 and a next level scanning signal Gn+1 are high electrical level at the same time, the H point is maintained at a high electrical level, the second clock signal CKV3 is high electrical level, the ninth controllable switch T9 is in a on state, the N point is in high electrical level, the third controllable switch T3 is turned on, the pull-up control signal point Q is charged, at the time the low electrical level of the fourth clock signal CKV2 pull down the electrical potential of the scanning line Gn;

The pull-up control signal point Q is pulled down to the turn-off voltage terminal signal VGL phase: when the first clock signal CKV1 further turns to the high electrical level, the previous level scanning signal Gn−1 is in low electrical level, the first controllable switch T1 and the eighth controllable switch T8 are in the on state, then the pull-up control signal point Q is pulled down to the turn-off voltage terminal signal VGL;

The low electrical level maintaining phase of the pull-up control signal point Q and the scanning line Gn: when the pull-up control signal point Q is became in low electrical level, the fourth controllable switch T4 is in the off state, after the fourth clock signal CKV2 becoming a high electrical level, due to the coupling of a capacitor C1, the pull-down control signal point P becomes in a high electrical level, then the sixth controllable switch T6 and the fifth controllable switch T5 are in a on state to guarantee the stable low electrical level of the pull-up control signal point Q and the scanning line Gn.

Figure 6:
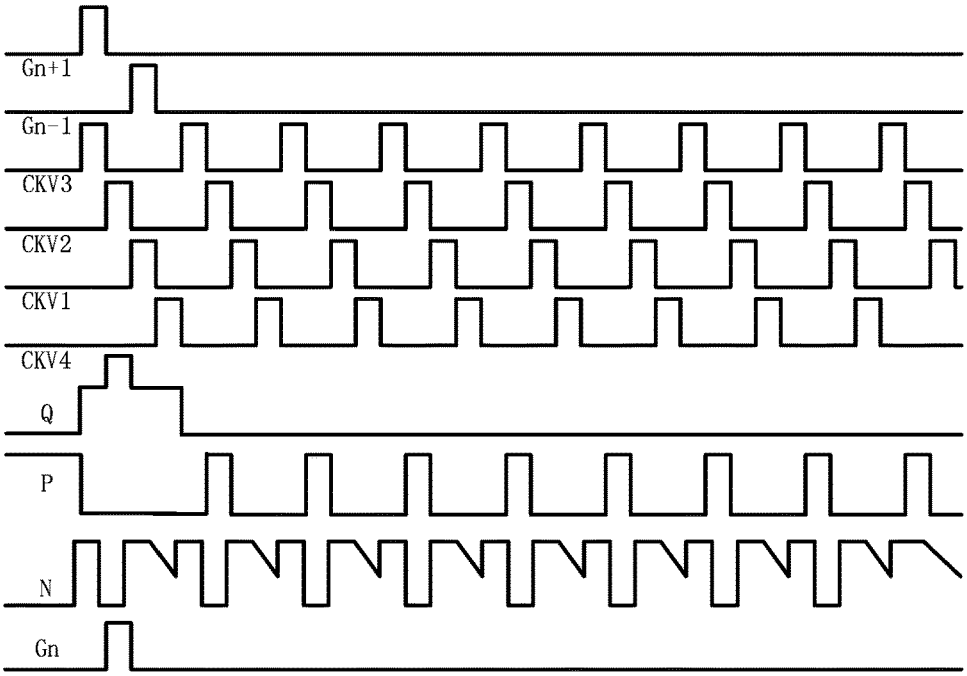
FIG. 6 illustrates a reverse scanning waveform diagram of FIG. 4.

Referring to FIG. 4 and FIG. 6, the working principle (reverse scanning) of a scanning driving unit of the scanning driving circuit is as follows:

Pre-charge phase: the next level scanning signal Gn+1 and the second clock signal CKV3 are simultaneously in a high electrical level, the second controllable switch T2 is turned on, the H point is pre-charged, the second clock signal CKV3 is in high electrical level, the ninth controllable switch T9 is in the on state, the N point is in high electrical level, the third controllable switch T3 is turned on, the pull-up control signal point Q is charged, when the H point is in high electrical level, the fourth controllable switch T4 is in the on state, the pull-down control signal point P is pull down;

The scanning line Gn output high electrical level phase: when the fourth clock signal CKV2 is from the low electrical level to the high electrical level, the pull-up control signal point Q is further charged by the function of the bootstrap of the capacitor C1, at this time the first clock signal CKV1 and the second clock signal CKV3 are in low electrical level, the eighth controllable switch T8 and the ninth controllable switch T9 are turned off, the tenth controllable switch T10 in on state, the N point is pulled down to the turn-off voltage terminal signal VGL, the third controllable switch T3 is in a turned off state, since the third capacitor C3 has a certain holding effect to the charge, the eleven controllable switch T11 is in a on state, the high electrical level of the fourth clock signal CKV2 is output to the scanning line Gn;

The scanning line Gn output low electrical level phase: the first clock signal CKV1 and the previous level scanning signal Gn−1 are high electrical level at the same time, the H point is maintained at a high electrical level, the first clock signal CKV1 is high electrical level, the eighth controllable switch T8 is in a on state, the N point is in high electrical level, the third controllable switch T3 is turned on, the pull-up control signal point Q is charged, at the time the low electrical level of the fourth clock signal CKV2 pull down the electrical potential of the scanning line Gn;

The pull-up control signal point Q is pulled down to the turn-off voltage terminal signal VGL phase: when the second clock signal CKV3 further turns to the high electrical level, the next level scanning signal Gn+1 is in low electrical level, the second controllable switch T2 and the ninth controllable switch T9 are in the on state, then the pull-up control signal point Q is pulled down to the turn-off voltage terminal signal VGL;

The low electrical level maintaining phase of the pull-up control signal point Q and the scanning line Gn: when the pull-up control signal point Q is became in low electrical level, the fourth controllable switch T4 is in the off state, after the fourth clock signal CKV2 becoming a high electrical level, due to the coupling of a capacitor C1, the pull-down control signal point P becomes in a high electrical level, then the sixth controllable switch T6 and the fifth controllable switch T5 are in a on state to guarantee the stable low electrical level of the pull-up control signal point Q and the scanning line Gn.

When the first clock signal CKV1 and the next level scanning signal Gn−1 are simultaneously in high electrical, the H point is pre-charged, at this time the eighth controllable switch T8 is also in the on state, N is in high electrical level, therefore the third controllable switch T3 will be in the on state, the pull-up control signal point Q will be charged by the H point, when the fourth clock signal CKV2 is from the low electrical level to high electrical level, because of the function of the bootstrap of the capacitor C1, the pull-up control signal point Q is re-charged, at this time the first clock signal CKV1 and the second clock signal CKV3 are in low electrical level, the eighth and ninth controllable switches T8 T9 are in the off state, but at this time the tenth controllable switch T10 is in the on state, the N points is pulled down to the turn-off voltage terminal signal VGL, the third controllable switch T3 is in off state, so it can be ensure that the high electrical potential of the pull-up control signal point Q is not affected by the H point, while the fourth controllable switch T4 is not affected by the high electrical potential of the pull-up control signal point Q, when the second clock signal CKV3 and next level scanning signal Gn+1 are simultaneously in high electrical, the H point is charged again and at this time the ninth controllable switch T9 is in the on state, the N point is pulled up, the third controllable switch T3 is in on state, the pull-up control signal point Q is continued to maintain in the high electrical level in order to effectively solve the problem of the decreasing of the electrical potential of the pull-up control signal point Q caused by the exiting leakage of the third controllable switch T3, and resulting in unstable output signal of the scanning line Gn, and to improve the display performance of the panel.

Figure 7:
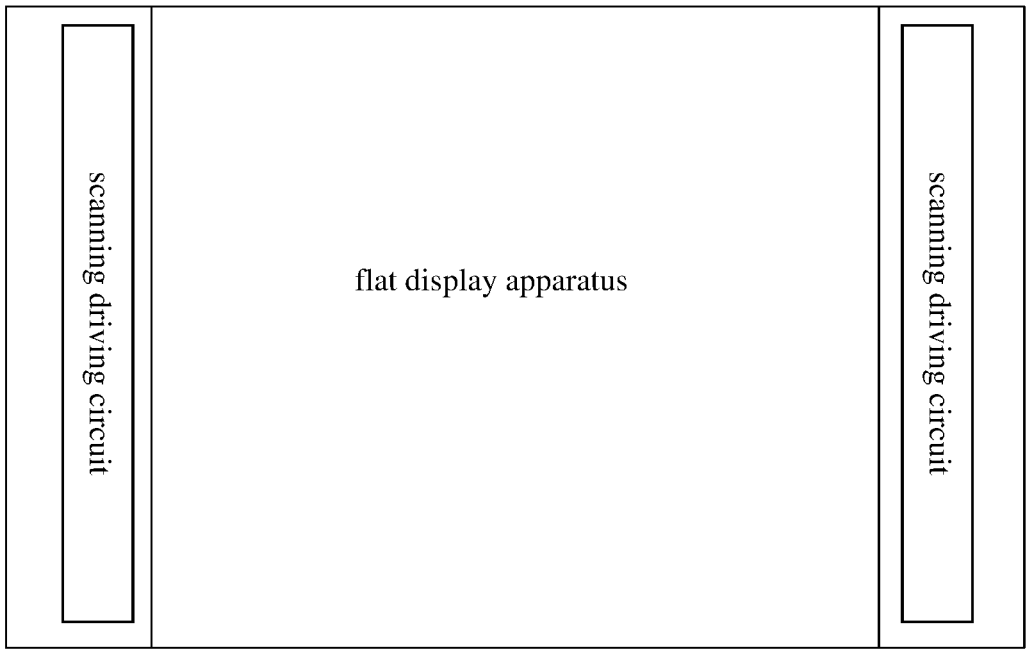
FIG. 7 is a schematic diagram of a flat display apparatus of the present application.

Referring to FIG. 7 is a schematic diagram of a flat display apparatus of the present application. The flat display apparatus includes the scanning driving circuit described above, the scanning driving circuit is disposed in the both ends of the flat display apparatus. Wherein the flat display apparatus is a liquid crystal display, LCD or an organic light emitting diodes, OLED. The other components and function of the flat display apparatus are the same with the components and function of the conventional flat display apparatus and not discussed here.

The scanning driving circuit of the present application performs the forward scanning and reverse scanning by the scanning driving circuit controlled by the forward and reverse scanning circuit, and by the input circuit to charge the pull-up control signal point and the pull-down control signal point, by the leakage prevention circuit to prevent the thin film transistor from leakage and resulting in unstable output signal of the scanning line, by the output circuit generating the scanning driving signal and outputting to the scanning line to drive the pixel unit, in order to improve the display performance of the panel.

Above are embodiments of the present application, which does not limit the scope of the present application. Any modifications, equivalent replacements or improvements within the spirit and principles of the embodiment described above should be covered by the protected scope of the invention.

What is claimed is:

1. A scanning driving circuit, wherein the scanning driving circuit comprising a plurality of cascaded scanning driving unit, each scanning driving unit comprising:

a forward and reverse scanning circuit for receiving a previous level scanning signal and a first clock signal and outputting a first control signal to control the scanning driving circuit performing forward scanning, or for receiving a next level scanning signal and a second clock signal and outputting a second control signal to control the scanning driving circuit performing reverse scanning;

an input circuit connected to the forward and reverse scanning circuit, for receiving a third clock signal and receiving the first and the second control signal from the forward and reverse scanning circuit, and according to the third clock signal, the first and the second control signal to perform charging to the pull-up control signal point and the pull-down control signal point;

a leakage prevention circuit connected to the input circuit, for receiving the first clock signal and the second clock signal, and preform a process to the leakage of the input circuit according to the first and the second clock signal; and an output circuit connected to the input circuit for preforming a process to a received fourth control signal and a data received from the input circuit, generating a scanning driving signal and outputting to the level scanning line to drive a pixel unit;

wherein the input circuit comprising a third to seventh controllable switches, a first and second capacitors, a control terminal of the third controllable switch is connected to the leakage prevention circuit, a first terminal of the third controllable switch is connected to a control terminal of the fourth controllable switch, the second terminal of the first controllable switch and the first terminal of the second controllable switch, a second terminal of the third controllable switch is connected to a first terminal of the fifth controllable switch and the output circuit, a second terminal of the fifth controllable switch is connected to a second terminal of the fourth controllable switch, a second terminal of the sixth controllable switch and a second terminal of the seventh controllable switch receive a turn-off voltage terminal signal, a control terminal of the fifth controllable switch is connected to a first terminal of the fourth controllable switch and a control terminal of the sixth controllable switch, a first terminal of the sixth controllable switch is connected to a first terminal of the seventh controllable switch and the output circuit, a control terminal of the seventh controllable switch receives the third clock signal, a first terminal of the first capacitor is connected to the control terminal of the fifth controllable switch, a second terminal of the first capacitor is connected to the output circuit, the second capacitor is connected between the control terminal and the second terminal of the sixth controllable switch.

2. The scanning driving circuit according to claim 1, wherein the forward and reverse scanning circuit comprising a first controllable switch and a second controllable switch, the control terminal of the first controllable switch receives the first clock signal, a first terminal of the controllable switch receives the previous level scanning signal, a second terminal of the first controllable switch is connected to the first terminal of the second controllable switch and the input circuit, a control terminal of the second controllable switch receives the second clock signal, a second terminal of the second controllable switch receives the next level scanning signal.

3. The scanning driving circuit according to claim 1, wherein the leakage prevention circuit comprising an eighth to tenth controllable switches, a control terminal of the eighth controllable switch receives the first clock signal, a first terminal of the eighth controllable switch is connected to a first terminal of the ninth controllable switch and receives a turn-on voltage terminal signal, a second terminal of the eighth controllable switch is connected to a second terminal of the ninth controllable switch, a second terminal of the tenth controllable switch and the control terminal of the third controllable switch, a control terminal of the ninth controllable switch receives the second clock signal, a first terminal of the tenth controllable switch receives the turn-off voltage terminal signal, a control terminal of the tenth controllable switch is connected to the second terminal of the first capacitor and the output circuit.

4. The scanning driving circuit according to claim 3, wherein the output circuit comprising an eleventh controllable switch and a third capacitor, a control terminal of the eleventh controllable switch is connected to the second terminal of the third controllable switch and the first terminal of the fifth controllable switch, a first terminal of the eleventh controllable switch is connected to the control terminal of the tenth controllable switch and the second terminal of the first capacitor and receives the fourth clock signal, a second terminal of the eleventh controllable switch is connected to the first terminals of the sixth and seventh controllable switches and the level scanning line, the third capacitor is connected between the control terminal and the second terminal of the eleventh controllable switch.

5. The scanning driving circuit according to claim 4, wherein the first to eleventh controllable switches are N-type thin film transistors, the control terminals, the first terminals and the second terminals of the first to eleventh controllable switches are corresponding to gate, drain and source electrodes of the N-type thin film transistors, respectively.

6. A flat display apparatus, wherein the flat display apparatus comprising a scanning driving circuit, the scanning driving circuit comprising a plurality of cascaded scanning driving unit, each scanning driving unit comprising:

a forward and reverse scanning circuit for receiving a previous level scanning signal and a first clock signal and outputting a first control signal to control the scanning driving circuit performing forward scanning, or for receiving a next level scanning signal and a second clock signal and outputting a second control signal to control the scanning driving circuit performing reverse scanning;

an input circuit connected to the forward and reverse scanning circuit, for receiving a third clock signal and receiving the first and the second control signal from the forward and reverse scanning circuit, and according to the third clock signal, the first and the second control signal to perform charging to the pull-up control signal point and the pull-down control signal point;

a leakage prevention circuit connected to the input circuit, for receiving the first clock signal and the second clock signal, and preform a process to the leakage of the input circuit according to the first and the second clock signal; and an output circuit connected to the input circuit for preforming a process to a received fourth control signal and a data received from the input circuit, generating a scanning driving signal and outputting to the level scanning line to drive a pixel unit;

wherein the input circuit comprising a third to seventh controllable switches, a first and second capacitors, a control terminal of the third controllable switch is connected to the leakage prevention circuit, a first terminal of the third controllable switch is connected to a control terminal of the fourth controllable switch, the second terminal of the first controllable switch and the first terminal of the second controllable switch, a second terminal of the third controllable switch is connected to a first terminal of the fifth controllable switch and the output circuit, a second terminal of the fifth controllable switch is connected to a second terminal of the fourth controllable switch, a second terminal of the sixth controllable switch and a second terminal of the seventh controllable switch receive a turn-off voltage terminal signal, a control terminal of the fifth controllable switch is connected to a first terminal of the fourth controllable switch and a control terminal of the sixth controllable switch, a first terminal of the sixth controllable switch is connected to a first terminal of the seventh controllable switch and the output circuit, a control terminal of the seventh controllable switch receives the third clock signal, a first terminal of the first capacitor is connected to the control terminal of the fifth controllable switch, a second terminal of the first capacitor is connected to the output circuit, the second capacitor is connected between the control terminal and the second terminal of the sixth controllable switch.

7. The flat display apparatus according to claim 6, wherein the forward and reverse scanning circuit comprising a first controllable switch and a second controllable switch, the control terminal of the first controllable switch receives the first clock signal, a first terminal of the controllable switch receives the previous level scanning signal, a second terminal of the first controllable switch is connected to the first terminal of the second controllable switch and the input circuit, a control terminal of the second controllable switch receives the second clock signal, a second terminal of the second controllable switch receives the next level scanning signal.

8. The flat display apparatus according to claim 6, wherein the leakage prevention circuit comprising an eighth to tenth controllable switches, a control terminal of the eighth controllable switch receives the first clock signal, a first terminal of the eighth controllable switch is connected to a first terminal of the ninth controllable switch and receives a turn-on voltage terminal signal, a second terminal of the eighth controllable switch is connected to a second terminal of the ninth controllable switch, a second terminal of the tenth controllable switch and the control terminal of the third controllable switch, a control terminal of the ninth controllable switch receives the second clock signal, a first terminal of the tenth controllable switch receives the turn-off voltage terminal signal, a control terminal of the tenth controllable switch is connected to the second terminal of the first capacitor and the output circuit.

9. The flat display apparatus according to claim 8, wherein the output circuit comprising an eleventh controllable switch and a third capacitor, a control terminal of the eleventh controllable switch is connected to the second terminal of the third controllable switch and the first terminal of the fifth controllable switch, a first terminal of the eleventh controllable switch is connected to the control terminal of the tenth controllable switch and the second terminal of the first capacitor and receives the fourth clock signal, a second terminal of the eleventh controllable switch is connected to the first terminals of the sixth and seventh controllable switches and the level scanning line, the third capacitor is connected between the control terminal and the second terminal of the eleventh controllable switch.

* * * * *